United States Patent [19]

Honda

[11] Patent Number: 4,803,521

[45] Date of Patent: Feb. 7, 1989

[54] PROCESS KIT AND IMAGE FORMING APPARATUS USING THE SAME

[75] Inventor: Haruhisa Honda, Yokohama, Japan

[73] Assignee: Canon Kabushiki Kaisha, Tokyo, Japan

[21] Appl. No.: 96,250

[22] Filed: Sep. 9, 1987

Related U.S. Application Data

[63] Continuation of Ser. No. 435,956, Oct. 22, 1982, abandoned.

[30] Foreign Application Priority Data

Oct. 29, 1981 [JP] Japan ..... 56-173555

[51] Int. Cl.[4] ..... G03G 21/00

[52] U.S. Cl. ..... 355/14 R; 355/4

[58] Field of Search ..... 355/3 R, 3 DR, 3 DD, 355/4, 14 R, 14 D; 118/645, 652; 354/21, 84

[56] References Cited

U.S. PATENT DOCUMENTS

| | | | |
|---|---|---|---|
| 3,880,518 | 4/1975 | Chatfield | 355/16 |
| 3,985,436 | 10/1976 | Tanaka et al. | 355/3 DD X |
| 4,097,139 | 6/1978 | Hauser et al. | 355/4 |
| 4,236,807 | 12/1980 | Kuehnle | 355/3 R |
| 4,260,248 | 4/1981 | Murata et al. | 355/60 |
| 4,270,856 | 6/1981 | Goida | 355/3 R |
| 4,315,685 | 2/1982 | Inuzuka et al. | 355/14 R |
| 4,339,776 | 7/1982 | Langer et al. | 360/132 X |
| 4,367,944 | 1/1983 | Kuru | 355/14 CH |
| 4,376,577 | 3/1983 | Okamoto | 355/3 DR |
| 4,376,579 | 3/1983 | Wakao | 355/3 DR |
| 4,386,838 | 6/1983 | Hirabayashi et al. | 355/3 DR |
| 4,386,839 | 6/1983 | Kumagai et al. | 355/3 DR |
| 4,386,841 | 6/1983 | Wakao et al. | 355/3 DR |
| 4,470,689 | 9/1984 | Nomura et al. | 355/3 R |
| 4,500,195 | 2/1985 | Hosono | 355/3 R |
| 4,551,000 | 11/1985 | Kanemitsu et al. | 355/3 R |

FOREIGN PATENT DOCUMENTS 2909387 9/1979 Fed. Rep. of Germany .

*Primary Examiner*—Fred L. Braun

*Attorney, Agent, or Firm*—Fitzpatrick, Cella, Harper & Scinto

[57] ABSTRACT

A process kit has at least part of image forming structure and is detachably mounted in the main body of an image forming apparatus, and an image forming apparatus using the process kit. Signal sources are disposed on the process kit in accordance with the functional purpose of the process kit. When a process kit is mounted in the main body of the image forming apparatus, the type or property of this process kit is automatically indicated at an indicator section of the main body, thus preventing erroneous use of an undesired process kit. The signal sources not only indicate the functional purpose of the process kit currently mounted in the main body but also automatically set image forming conditions which differ for various kits, thus reproducing high-quality images.

22 Claims, 5 Drawing Sheets

PROCESS KIT AND IMAGE FORMING APPARATUS USING THE SAME

This application is a continuation of application Ser. No. 435,956, filed Oct. 22, 1982, now abandoned.

BACKGROUND OF THE INVENTION

1. Field of the Invention

The present invention relates to a process kit of an image forming apparatus, which kit has a plurality of image forming means and is detachable from the image forming apparatus, and relates to the image forming apparatus using the process kit.

2. Description of the Prior Art

In conventional copying apparatuses using electrophotography, various maintenance operations must be performed, such as replacement of a photosensitive drum replenishment and replacement of a developer, cleaning of a charging wire, and other inspection. Such maintenance operations are carried out by a serviceman. Recently, some methods allowing simple maintenance operation have been proposed, which eliminate the necessity of relying on the serviceman having special knowledge. In one of such methods, an assembly of components such as a discharger, a developer unit and a photosensitive drum or a combination thereof, that is, a process kit, is replaced with a new assembly or combination.

Since the process kit of the type described above is easily replaced with a new one for the copying apparatus, the user can possess various process kits each having given developing characteristics and image reproducibility, and can use one of the process kits in accordance with his needs. The process kits may include: a process kit for properly reproducing an original image with excellent edge effect; a process kit for properly reproducing a half-tone image such as a picture; and a process kit having black and red developer units.

As described above, since a plurality of process kits are available, the user must confirm which type of process kit is currently mounted in the apparatus. If an undesirable process kit is currently mounted in the apparatus, the apparatus may reproduce an unwanted copy. This results in time-consuming and wasteful operation.

SUMMARY OF THE INVENTION

The present invention has been made in consideration of the above situation, and it is an object of the present invention to indicate the function of a process kit currently mounted in an image forming apparatus, thereby improving operability of the image forming apparatus.

It is another object of the present invention to automatically set image forming means of the image forming apparatus in accordance with image forming conditions corresponding to the function of the process kit, so as to obtain a high-quality image, in addition to signalling the function of the process kit to the user.

According to one aspect of the present invention, there is provided a process kit which has at least part of the image forming means of an image forming apparatus and a signal source for producing a signal corresponding to the functional purpose of the process kit so as to indicate the content of the process kit at an indicator section in the image forming apparatus. Furthermore, the signal source of the process kit can also set the image forming conditions as well as indicate the process kit content.

According to another aspect of the present invention, there is also provided an image forming apparatus in which the process kit having at least part of the image forming means of the image forming apparatus is detachably mounted, the content of the process kit being indicated at the indicator section of the image forming apparatus by means of and in accordance with the signal source. Furthermore, the signal source can be used to set the image forming conditions.

DETAILED DESCRIPTION OF THE PREFERRED EMBODIMENTS

An embodiment of the present invention will be described with reference to the accompanying drawings.

Figure 1:
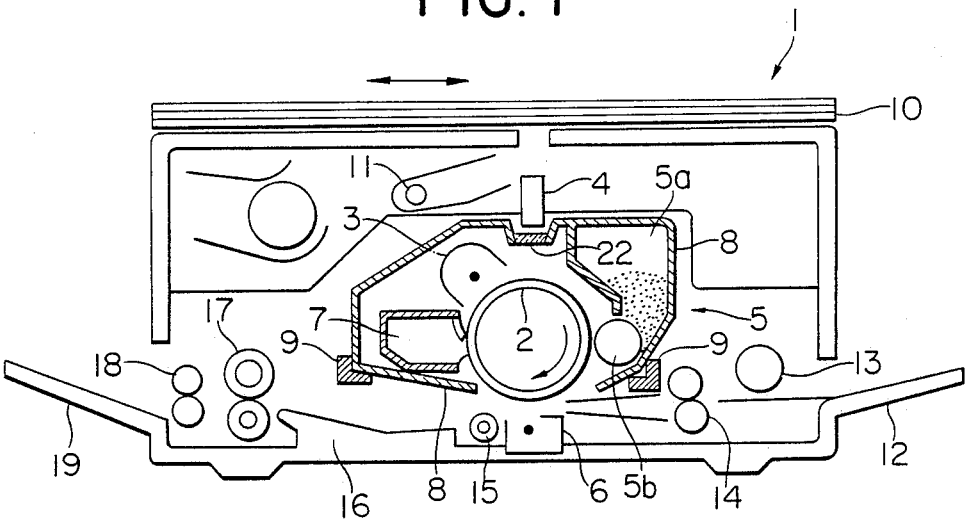
FIG. 1 is a sectional view showing the main part of an electrophotographic copying apparatus to which the present invention is applied.

FIG. 1 is a sectional view showing the main part of the electrophotographic copying apparatus to which the embodiment of the present invention is applied.

An electrophotographic copying apparatus 1 includes a photosensitive drum 2 comprising an electrically conductive drum base and a photoconductive layer formed thereon. The drum 2 is supported to be rotatable in the direction indicated by the arrow. A corona discharger 3, a short-focal point optical element array 4, a developer unit 5, a transfer corona discharger 6, and a cleaner 7 are disposed around the photosensitive drum 2 along the rotational direction thereof in the order named. In the electrophotographic copying apparatus 1, the photosensitive drum 2 together with the corona discharger 3, the developer unit 5 and the cleaner 7 are integrally supported in a housing 8. The housing 8 is guided and supported by guide rails 9 secured to the electrophotographic copying apparatus 1 and is detachably mounted therein. The developer unit 5 has a hopper **5*a* for storing a developer or toner at the upper portion thereof in a known manner, and a rotatable member 5*b* for supplying the developer to the photosensitive drum 2 at the lower portion of the developer unit 5. A one-component developer consisting of a magnetic toner, or a two-component developer consisting of a toner and a magnetic carrier can be used as a developer in the electrophotographic copying apparatus of the present invention. The rotatable member 5b** may comprise a magnetic roller having a polarity on its surface, or a member having a magnetic roller therein and a nonmagnetic sleeve on its surface. The cleaner may comprise a blade or a fur brush.

In the above embodiment shown in FIG. 1, a one-component magnetic developer is used, in conjunction with the rotatable member 56 and the cleaner unit 7.

In the above electrophotographic copying apparatus 1, the surface of the photosensitive drum 2 is uniformly charged with a predetermined polarity by means of the corona discharger 3. An original on a reciprocating original table 10 at the upper portion of the apparatus 1 is illuminated by a lamp 11. Light reflected by the original is incident on the photosensitive drum 2 through the optical element array 4. Thus, an electrostatic latent image is formed on the surface of the photosensitive drum 2. This latent image is developed by the developer unit 5. The developed image is transferred to a transfer medium by the transfer corona discharger 6. Transfer media are manually placed by the operator in a transfer medium supply tray 12. Each transfer medium is then conveyed to a transfer unit through a pickup roller 13 and timing rollers 14. The transfer medium to which the electrostatic latent image is transferred is separated by a separating means 15 and is fed to a fixer 17 through a conveying passage 16. The image on the transfer medium is thus fixed by the fixer 17. The transfer medium is then discharged into a discharge tray 19 through discharge rollers 18.

Figure 2:
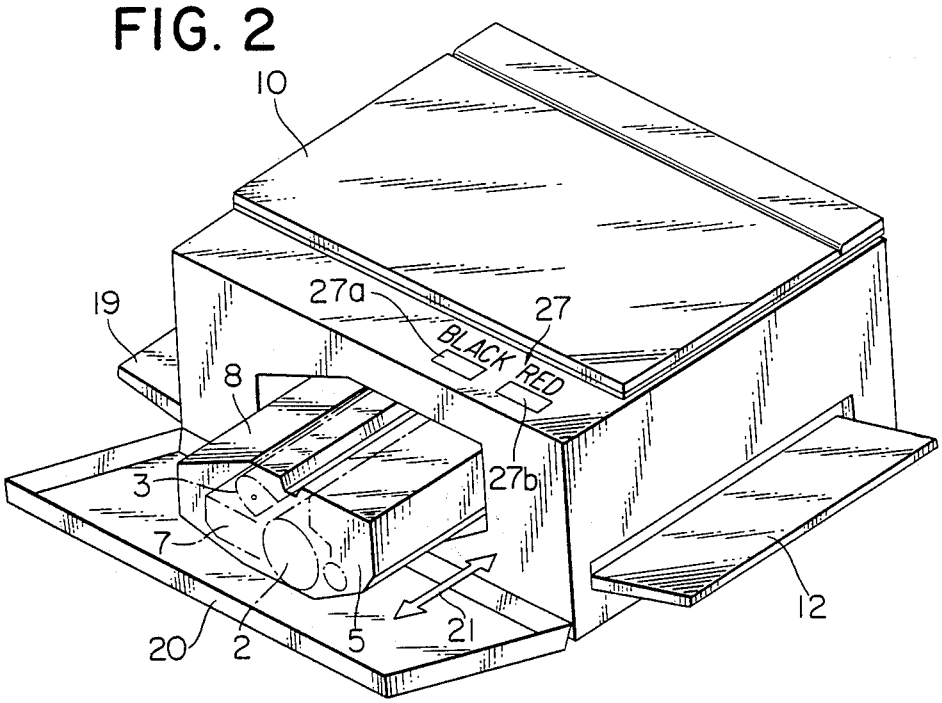
FIG. 2 is a perspective view showing the removal of a process kit from the electronic copying apparatus.

FIG. 2 is a perspective view showing the detachment/attachment of the process kit from/to the electrophotographic copying apparatus 1. The operator opens a front door 20 to insert the housing 8 into the electrophotographic copying apparatus 1 along the guide rails 9 or to remove it therefrom. The housing 8 moves in the direction indicated by the arrow 21 at the time of removal or insertion.

In the image forming apparatus having the construction described above, the replacement of one process kit with another allows the user to obtain different color images using the same image forming apparatus. For example, the process kit having black toner is replaced with the process kit having red toner to obtain a red image, and vice versa. The process kit for obtaining a black image is called a black kit, and the process kit for obtaining a red image is called a red kit hereinafter, for descriptive convenience. These kits use spectral sensitivity of the photosensitive drum 2 or a color correction filter 22 as shown in FIGS. 1 and 3, as needed, to emphasize a desired color by changing a spectral transmittance.

As described above, when the user possesses two kinds of process kits for different color copies, he must discriminate which process kit is currently mounted in the electrophotographic copying apparatus 1.

Figure 3:
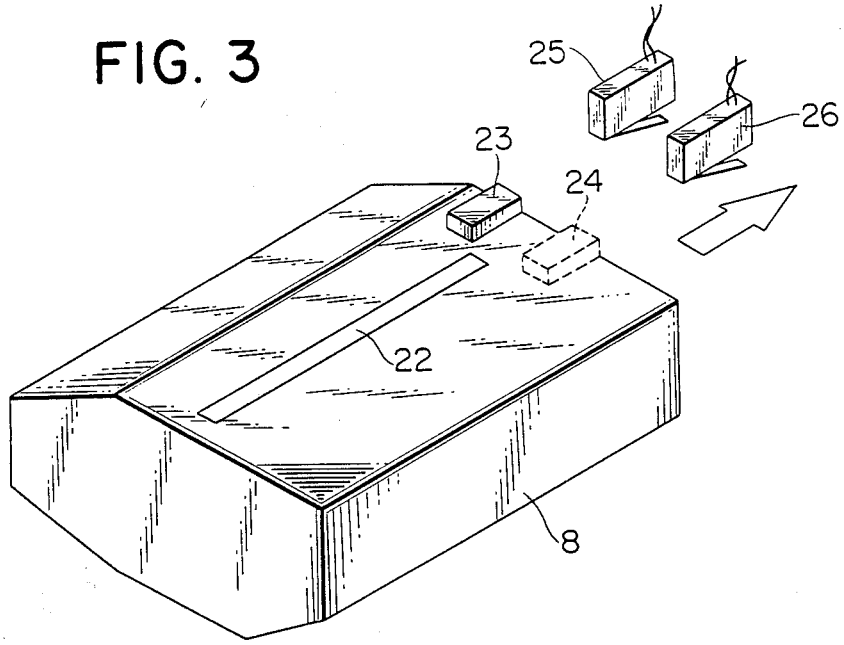
FIG. 3 is a schematic view of a mechanism for signalling the type of process kit to the electronic copying apparatus.

FIG. 3 is a perspective view for explaining the method of confirmation of which process kit is currently mounted in the apparatus 1. More particularly, the relationship between the signal generating means (namely, the cams 23, 24 and microswitches 25, 26) of the electrophotographic copying apparatus 1 and of the housing 8 is shown.

Figure 4:
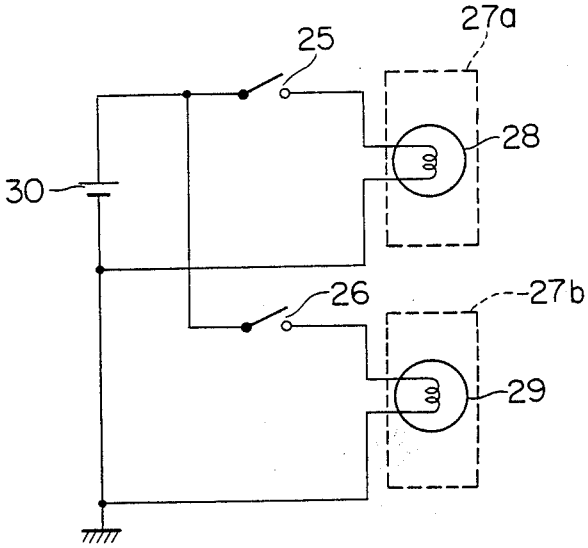
FIG. 4 is a circuit diagram of an indicator section.

Referring to FIG. 3, projections 23 and 24 disposed on the upper surface of the housing near the edge thereof are signal sources. In practice, the projection 23 is provided on the black kit, while the projection 24 is provided on the red kit. Two microswitches 25 and 26 are arranged on the electrophotographic copying apparatus 1 and correspond to the projections 23 and 24, respectively. When a process kit is mounted in the electrophotographic copying apparatus 1, one of the microswitches 25 and 26 is ON in accordance with the type of process kit. The type of process kit currently mounted in the apparatus 1 is automatically indicated by one of the indicators (FIG. 4) of an indicator section 27 shown in FIG. 2. Referring to FIG. 4, indicator lamps 28 and 29 are connected to a power source 30 which is arranged in the electrophotographic copying apparatus 1. As shown in FIG. 1, an indicator 27a goes on when the black kit is currently mounted in the electrophotographic copying apparatus 1 while an indicator 27b goes on when the red kit is currently mounted therein.

The user can confirm the type of the process kit currently mounted in the electrophotographic copying apparatus 1 without opening the front door 20, thus improving operability.

Furthermore, when the user wishes to mount different kits having different functions in the electrophotographic copying apparatus 1, the image forming conditions of the electrophotographic copying apparatus 1 can be set by the signal sources or projections 23 and 24 in accordance with the type of process kit. For example, with the image forming conditions to produce an optimum image when the black kit is used, the red kit cannot be used to produce an optimum image since the red toner has different development characteristics from the black toner. In this case, a development bias voltage can be properly changed by a circuit shown in FIG. 5 so as to obtain an optimum image in accordance with the process kit currently mounted in the electronic copying apparatus 1.

Figure 5:
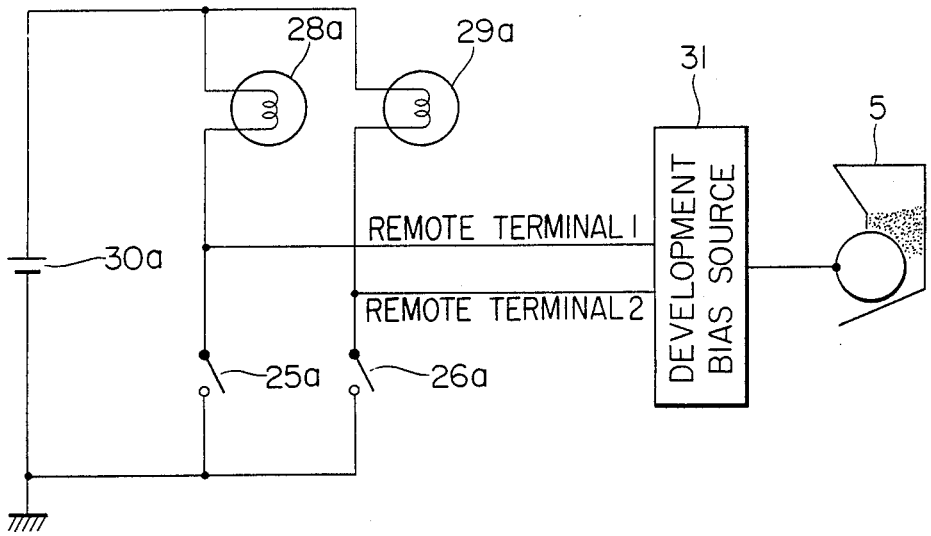
FIG. 5 is a circuit diagram of a circuit for changing the mode of indication and the development conditions.

Referring to FIG. 5, a power source 30a is connected in series with a parallel circuit of indicator lamps 28a and 29a. A microswitch 25a is connected in series with the indicator lamp 28a, and a microswitch 26a is connected in series with the indicator lamp 29a. The common node between the indicator lamp 28a and the microswitch 25a and the common node between the indicator lamp 29a and the microswitch 26a are connected to a development bias source 31. When input voltages to remote terminals 1 and 2 of the development bias source 31 are respectively set at 0V, the development bias source 31 respectively produces different voltages which are applied to the developer unit 5. When the black kit is mounted in the electrophotographic copying apparatus 1, the microswitch 25a is ON to cause the indicator lamp 28a to be ON. At the same time, the remote terminal 1 of the development bias source 31 is set at 0V. A voltage corresponding to the black kit is supplied from the development bias source 31 to the development roller section of the developer unit 5.

At this time, when the black kit is removed from the electrophotographic copying apparatus 1 and the red kit is mounted therein in place thereof, the switch 26a is ON to cause the indicator lamp 29a to be ON. A voltage suitable for development conditions of the red kit is applied to the developer unit 5. The development bias voltages, which are variable in accordance with the type of process kit, may be a voltage obtained by adding a DC voltage to a reference bias voltage. Where an AC reference bias voltage is used, the frequency of the reference bias voltage may be variable.

In the above embodiment, the development bias source 31 is used to apply different voltages to the developer unit 31. However, by changing a voltage applied to the corona discharger 3 in accordance with the type of process kit, by changing an ON voltage of the lamp 11, or by changing a potential of the electrostatic latent image in accordance with the type of process kit, a difference in the development characteristics of the electrostatic latent image may be compensated.

In addition to the black and red kits, other process kits having different functions and purposes may be used, such as a line copy kit and a picture copy kit.

Figure 6:
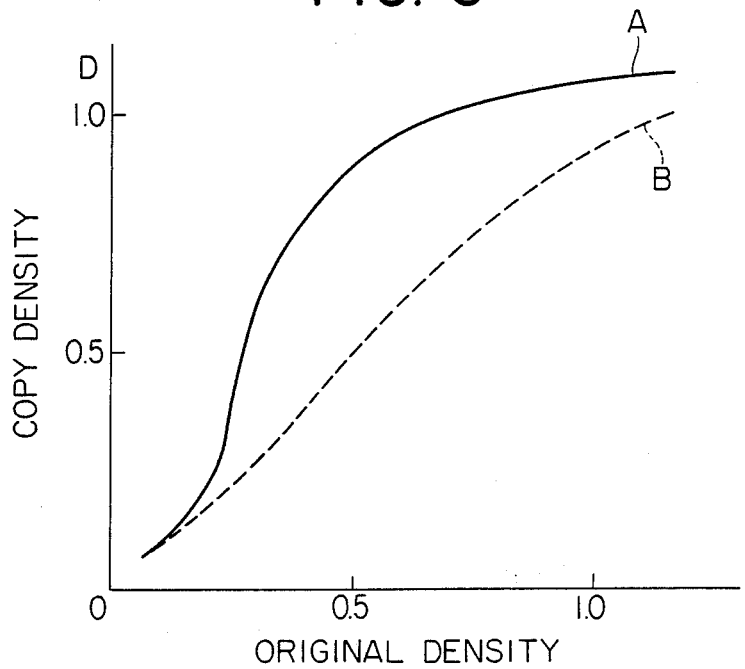
FIG. 6 is a graph showing the copy density as a function of the original density.

With reference to the relationship between the original density and the copy density in FIG. 6, gradient $\gamma$ of curve A representing the relationship between the copy density D from white to black and the original density from white to black is steep in the line copy kit. As a result, a thin character and a thin line can be clearly reproduced with high contrast. However, reproduction of the half tone image is difficult under the above conditions. That is, the contrast of a picture image is overemphasized, and the reproduced image is not faithful. The picture copy kit has characteristics indicated by curve B in which only vague images can be obtained for a thin character and line. However, curve B indicates that half tone images can be properly and consistently obtained.

Figure 7:
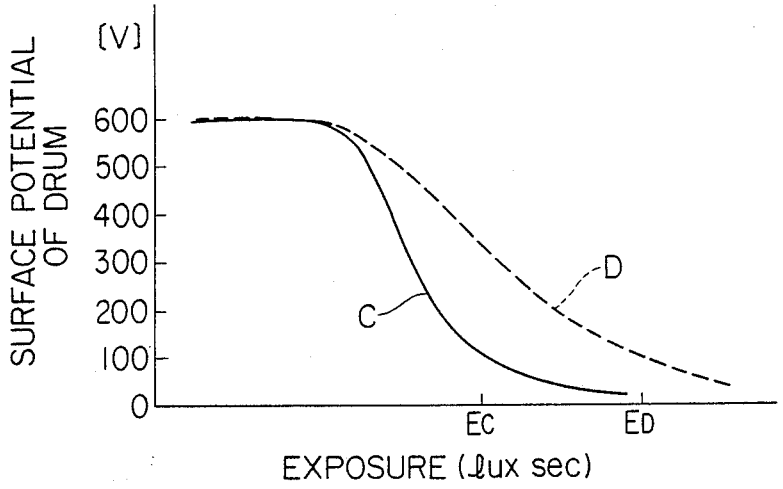
FIG. 7 is a graph showing the surface potential of the photosensitive drum as a function of the exposure.

As an example of preparing process kits which have different image characteristics, photosensitive bodies having different sensitivities (Exposure-Voltage or E-V characteristics) are used. Referring to FIG. 7, the E-V characteristic for the line copy kit is indicated by the steep gradient $\gamma$ of curve C, while the E-V characteristic for the picture copy kit is indicated by the moderate gradient $\gamma$ of curve D. In this case, it is sometimes possible that, in accordance with photosensitive bodies having different sensitivities, the amount of light from the exposure lamp 11, that is, the exposure, must be adjusted. More particularly, an example is illustrated with reference to FIG. 7. Assume that a voltage providing non-foggy images is 100V. A voltage applied to the exposure lamp 11 is adjusted or an exposure is adjusted by an aperture means so as to set the exposures at $E_C$ for curve C and at $E_D$ for curve D in accordance with the photosensitive bodies having curves C and D characteristics, respectively, when the background of the original is white. For example, when an OPC photosensitive body (curve C) having an exposure $E_C$ of 10 lux.sec and another OPC photosensitive body (curve D) having an exposure $E_D$ of 15 lux.sec are used, the amount of light is proportional to the power of 3.36 of the applied voltage. Therefore, the ON voltage is set at 60V for curve C, while the ON voltage is set at 68V for curve D. This may be easily accomplished by simply changing the resistance of the voltage control circuit, by means of the microswitches 25 and 26. Alternatively, when a diaphragm for adjusting the aperture of the optical lens is provided, the F number for curve C may be set to F/5.5, while the F number may be set to F/4.5 for curve D. In this case, the microswitches 25 and 26 may be used to change the stop position of the stopper for stopping the diaphragm blades.

Even when the above kits are used, signal generating means in accordance with the functional purpose of the kit must be provided to indicate the function of the kit at the indicator section in the same manner as it is indicated whether the red or black kit is used. Furthermore, the image forming conditions corresponding to the functional purpose of the process kit currently mounted in the apparatus can be changed. More particularly, in the same control method as shown in FIG. 5, the type of kit is indicated at the apparatus. At the same time, the amount of light of the exposure lamp 11 may be changed.

Figure 8:
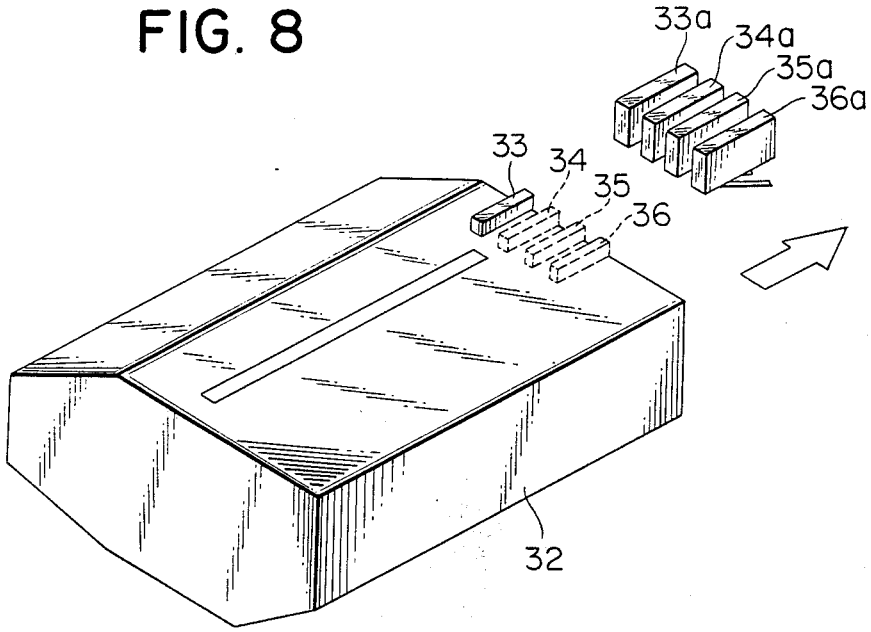
FIG. 8 is a perspective view of a kit having a means for correcting the operating conditions, except for the functional purpose.

FIG. 8 shows another example of a process kit in which the variation in the characteristics of the photosensitive body among the image forming conditions can be corrected, in addition to the indication of the content of the process kit currently mounted in the apparatus and the setting of the image forming conditions. One of the four projections 33, 34, 35 and 36 is mounted on a process kit 32. The projections 33 and 34 correspond to a black kit, while the projections 35 and 36 correspond to a red kit. Four microswitches **33*a*, 34*a*, 35*a* and 36*a* are arranged in the apparatus and respectively correspond to the projections 33, 34, 35 and 36**.

In the manufacturing process of the photosensitive drum, sensitivity variation occurs due to differences in chemical and physical treatments and the mixing ratio of the materials at the manufacturing time. Therefore, even if the standard black kit is mounted in the apparatus, the image quality differs for photosensitive bodies of high and low sensitivities. The structure of the process kit shown in FIG. 8 eliminates the above problem. When a high-sensitivity black kit is used, the projection 33 is disposed thereon. When a low-sensitivity black kit is used, the projection 34 is disposed thereon. The positions of the projections are not limited to two. Several positions may be selected for the projection for better control. When the process kit of the type described above is mounted in the apparatus and when the corresponding microswitch selects the control circuit, the charge and exposure of the corona discharger 3 and the development bias voltage can be easily changed in accordance with the given sensitivity of the photosensitive body. Therefore, it is possible to compensate for a variation in the density of the copied image where the variation is caused by the difference between the sensitivities of the photosensitive bodies. The signal source can thus be used only to compensate for the above variation.

As an example for setting the image forming conditions when the sensitivities of the photosensitive drums are different, in order to maintain the potential at the light portion of the electrostatic latent image by changing the amount of light, the standard exposure to maintain the potential at −100V at the light portion of the electrostatic latent image is set to 12 lux.sec. When the exposure varies within the range of 10 to 14 lux.sec., in accordance with the type of photosensitive drum, the projection 34 which turns on the microswitch **34*a* must be suitably disposed for a photosensitive drum of 12 to 14 lux.sec., and the projection 33 which turns on the microswitch 33*a* must be suitably disposed for a photosensitive drum of 10 to 12 lux.sec. Since the microswitches 33*a* and 34*a* change the resistance of the lamp control circuit, they can also be used to switch the lamp ON voltages. In this case, the exposure is set at 11 lux.sec when the microswitch 33*a* is ON, and the exposure is set at 13 lux.sec when the microswitch 34*a*** is ON. Thus, the proper amount of light can be obtained for every photosensitive drum.

Alternatively, the image forming conditions may be set such that the mounting position of the projection is determined to change the development bias voltage. For example, when a predetermined exposure is used, the potential at the light portion of the electrostatic latent image may vary within a range of −50 to −150V. In this case, when a developer system is used which is properly operated at −30V at the light portion of the latent image, a development bias voltage of −105V is applied to the developer rollers when the potential at the light portion of the latent image on the photosensitive drum is within a range of −50 to −100V. A development bias voltage of −155V is applied to the developer rollers when the potential at the light portion of the latent image on the photosensitive drum is within a range of −100 to −150V. The above change in the development bias voltage can be performed in the same manner as in FIG. 5.

Figure 9:
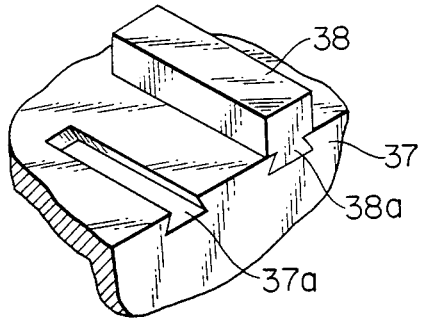
FIGS. 9 and 10 are perspective views of projections for operating the switch on the electronic copying apparatus.

FIG. 9 is a partial perspective view of a process kit 37 showing the method of mounting the signal source thereon. When the housing of the process kit is manufactured, the functional purpose of a kit to be manufactured and the sensitivity of the photosensitive drum to be housed therein are not yet definite. Therefore, a plurality of grooves 37*a* are formed on the housing, as shown in FIG. 9. When the characteristics of the photosensitive drum and the kit have been determined, a pin 38 may be fitted in a desired groove. The pin 38 has a projection 38*a* which is fitted in the groove 37*a* such that the pin 38 is inserted along the groove 37*a*.

In the above structure, since the signal pin can be disposed on the housing after the characteristics of the process kit are determined, the grooves need not be formed in accordance with the type of process kits. Therefore, even when the functional purpose of the housing and the characteristics of the photosensitive body are changed, the projection of the pin may be fitted in a desired groove. As a result, various types of housings need not be prepared.

Figure 10:
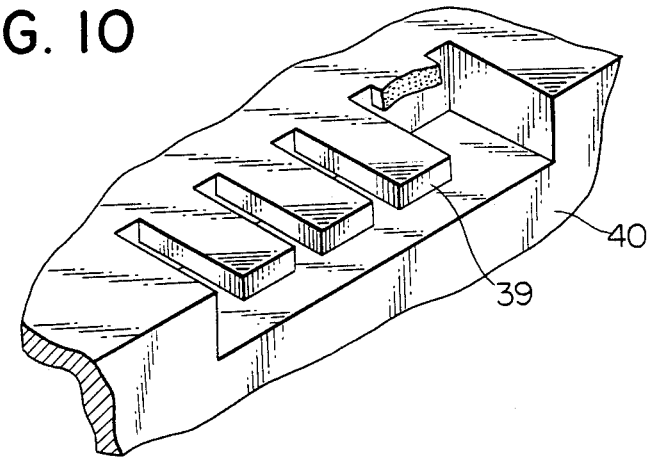
Figure 11:
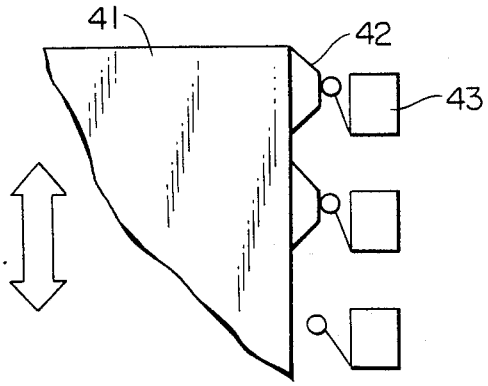
FIG. 11 is a plan view of a modification to the method of mounting the signal source on the process kit.

As shown in FIG. 9, the pin has a trapezoidal projection which is fitted in the trapezoidal groove. Alternatively, as shown in FIG. 10, removable projections 39 may be formed integrally with the housing of the process kit. In this case, after the characteristics of the process kit are determined, unnecessary projections 39 may be cut off to form a predetermined projection pattern. FIG. 11 shows a modification to the method of mounting the signal source. Projections 42 formed on a housing 41 correspond to microswitches 43 in the electrophotographic copying apparatus. The arrow indicates the detachable direction of the process kit.

In addition to the combination of the microswitch and the projection-groove described above, any other assembly may be used as the signal source of the process kit and the detecting means of the electrophotographic copying apparatus.

For example, magnetic members may be selectively disposed on the process kit and may be detected by Hall ICs disposed in the electrophotographic copying apparatus. Alternatively, the optical path between the light source and the light-receiving element in the electrophotographic copying apparatus may be blocked by projections selectively disposed on the process kit.

The signal sources and the detecting means need not be limited to the number used in the above embodiment. When the number of the signal sources and the detecting means is increased, a high-quality image can be reproduced and image forming conditions can be easily corrected.

The processing means disposed integrally within the process kit includes the photosensitive drum, the corona discharger, the developer unit, and the cleaner. However, the processing means disposed in the process kit need not be limited to the above components. For example, a combination of the discharger and the photosensitive drum, or another means for forming an image can be used together with the processing means described above.

Furthermore, the process kit of the present invention is not only applicable to the electrophotographic copying apparatus but also to a recording apparatus using a laser beam modulated for image exposure and an LED array. For example, image outputs from facsimiles and computers may be obtained.

What is claimed is:

1. A process kit receivable into an image forming apparatus having a main body portion, comprising:

process means including a photosensitive member and means actable thereon for repetitive image formation, for cooperating with means of the image forming apparatus to form images repetitively on image transfer material;

supporting means for supporting said process means as a kit; and signal source means disposed on said process kit for indicating to the main body of said image forming apparatus information corresponding to a processing property of said process means within the kit, for use by said main body to provide a display indicating said property so as to visually confirm said property.

2. A process kit according to claim 1, wherein said process means includes a developing device and said property of the process means relates to said developing device.

3. A process kit according to claim 2, wherein said property is a development color.

4. A process kit according to claim 2, wherein said property is a developing property.

5. A process kit receivable into an image forming apparatus having a main body portion, comprising:

process means including a photosensitive member and means actable thereof for repetitive image formation, for cooperating with means of the image forming apparatus to form images repetitively on image transfer material;

supporting means for supporting said process means as a kit; and common signal source means, disposed on said process kit, for indicating to the main body of said image forming apparatus a processing property of said process kit, for use by said main body to provide a visual display of such property, and for simultaneously causing an image forming operation to vary in accordance with the property of said process kit.

6. A process kit according to claim 5, wherein said process means includes a developing device and said property of the process kit relates to said developing device.

7. A process kit according to claim 6, wherein said property is a development color.

8. A process kit according to claim 6, wherein said property is a developing property.

9. A process kit according to claim 5, wherein said image forming operation is a change in a development bias voltage.

10. A process kit receivable into an image forming apparatus, comprising:

process means including a photosensitive member and means actable thereon for repetitive image formation, for cooperating with means of the image forming apparatus to form images repetitively on image transfer material;

supporting means for supporting said process means as a kit; and common signal source means, disposed on said process kit, providing an indication of a property of said process kit to said main body, for use by said main body to provide a visual display of said property wherein said signal source means corrects a variation in image quality due to non-uniform characteristics of components of said process kit arising in a manufacturing process thereof, and simultaneously causes an image forming operation to vary in accordance with the property of said process kit.

11. A process kit according to claim 10, wherein said process means includes a developing device and said property of the process kit relates to said developing device.

12. A process kit according to claim 11, wherein said property is a development color.

13. A process kit according to claim 10, wherein said image forming operation is a change in a developing bias voltage.

14. An image forming apparatus comprising:

A. a plurality of interchangeable process kits, each process kit including:

process means including a photosensitive member and means actable thereon for repetitive image formation, for cooperating with additional means of the image forming apparatus to form images repetitively on image transfer material;

supporting means for supporting said process means as a kit; and signal sources disposed on said process kit to indicate information for visual confirmation concerning a processing property of said process means within the kit;

B. a main body for mounting therein any of said interchangeable process kits and including:

said additional means for forming repetitive images;

detecting means for detecting the signal sources disposed on said process kit mounted in said main body; and indicating means for visually indicating the processing property of the process means of said kit mounted in said main body on the basis of a detected result of said detecting means so as to provide visual confirmation of said property.

15. An image forming apparatus according to claim 14, wherein said process means includes a developing device and said property of the process means relates to said developing device.

16. An image forming apparatus according to claim 15, wherein said property is a development color.

17. An image forming apparatus according to claim 15, wherein said property is a developing property.

18. An image forming apparatus comprising:

A. a plurality of interchangeable process kits, each process kit including:

process means including a photosensitive member and means actable thereon for repetitive image formation for cooperating with additional means of the image forming apparatus to form images repetitively on image transfer material;

supporting means for supporting said process means as a kit; and signal sources, disposed on said process kit providing a signal concerning a property of the property kit, for correcting a variation in an image quality due to non-uniform characteristics of components of said process kit arising in a manufacturing process thereof and for simultaneously causing operation of said image forming means to vary in accordance with the property of said process kit;

B. A main body for mounting therein any of said interchangeable process kits and including:

said additional means for forming repetitive images;

detecting means for detecting said signal sources disposed on said process kit mounted in said main body;

indicating means for visually indicating a content of a detected result of said detecting means so as to provide a visual confirmation of said content; and means for varying operating conditions of image forming means on the basis of the detected result of said detecting means.

19. An image forming apparatus according to claim 18, wherein said process means includes a developing device and said property of the process kit relates to said developing device.

20. An image forming apparatus according to claim 19, wherein said property is a development color.

21. A image forming apparatus according to claim 19, wherein said property is a developing property.

22. A image forming apparatus according to claim 18, wherein one of said varying operating conditions is a change in a development bias voltage.

* * * * *